US008679298B2

(12) United States Patent
Lah

(10) Patent No.: US 8,679,298 B2
(45) Date of Patent: Mar. 25, 2014

(54) REMOTELY CONTROLLED DECOKING TOOL USED IN COKE CUTTING OPERATIONS

(75) Inventor: Ruben F. Lah, South Jordan, UT (US)

(73) Assignee: Curtiss-Wright Flow Control Corporation, Falls Church, VA (US)

( * ) Notice: Subject to any disclaimer, the term of this patent is extended or adjusted under 35 U.S.C. 154(b) by 1269 days.

(21) Appl. No.: 12/348,768

(22) Filed: Jan. 5, 2009

(65) Prior Publication Data

US 2009/0200152 A1 Aug. 13, 2009

Related U.S. Application Data

(63) Continuation-in-part of application No. 11/245,384, filed on Oct. 6, 2005, now Pat. No. 7,473,337, which is a continuation-in-part of application No. 10/997,234, filed on Nov. 24, 2004, now Pat. No. 7,117,959.

(60) Provisional application No. 60/564,449, filed on Apr. 22, 2004.

(51) Int. Cl.
*C10B 1/00* (2006.01)
*C10B 35/00* (2006.01)

(52) U.S. Cl.
USPC ..... 202/241; 134/167 R; 134/167 C; 175/215; 202/262

(58) Field of Classification Search
USPC ..... 202/241, 242, 262; 134/22.18, 39, 134/167 R, 167 C; 175/67, 215; 239/446; 201/2
See application file for complete search history.

(56) References Cited

U.S. PATENT DOCUMENTS

| | | | |
|---|---|---|---|
| 176,321 | A | 4/1876 | Kromer |
| 1,656,355 | A | 1/1928 | Huffmann |
| 1,991,621 | A | 2/1935 | Noll |
| 2,064,567 | A | 12/1936 | Riley |
| 2,245,554 | A | 6/1941 | Court |
| 2,317,566 | A | 4/1943 | Utterback |
| 2,403,608 | A | 7/1946 | Payne |
| 2,562,285 | A | 7/1951 | Timmer |
| 2,717,865 | A | 9/1955 | Kimberlin, Jr. et al. |
| 2,734,715 | A | 2/1956 | Knox |
| 2,761,160 | A | 9/1956 | Manning |
| 2,950,897 | A | 8/1960 | Bryant |

(Continued)

FOREIGN PATENT DOCUMENTS

| | | |
|---|---|---|
| JP | 2000145989 | 5/2000 |
| RU | 2043604 | 10/1995 |

(Continued)

OTHER PUBLICATIONS

U.S. Appl. No. 10/731,874, Non-Final Rejection issued Feb. 23, 2005 by the United States Patent and Trademark Office. pp. 1-10.

(Continued)

*Primary Examiner* — Nina Bhat
(74) *Attorney, Agent, or Firm* — Kirton McConkie; Michael F. Krieger

(57) ABSTRACT

The present a system structured to allows an operator to remotely switch between cutting and boring while removing solid carbonaceous residue from large cylindrical vessels called coke drums utilizing—a cutting head for ejecting high pressure fluids into the coke bed; a flow diversion apparatus; and a shifting apparatus.

28 Claims, 9 Drawing Sheets

(56) References Cited

U.S. PATENT DOCUMENTS

| | | | | |
|---|---|---|---|---|
| 3,215,399 | A | 11/1965 | McInerney et al. | |
| 3,367,625 | A | 2/1968 | Fortune | |
| 3,379,623 | A | 4/1968 | Forsyth | |
| 3,617,480 | A | 11/1971 | Keel | |
| 3,646,947 | A | 3/1972 | Rochelle et al. | |
| 3,716,310 | A | 2/1973 | Guenther | |
| 3,837,356 | A | 9/1974 | Selep et al. | |
| 3,852,047 | A | 12/1974 | Schlinger et al. | |
| 4,125,438 | A | 11/1978 | Kelly et al. | |
| 4,174,728 | A | 11/1979 | Usnick et al. | |
| 4,253,487 | A | 3/1981 | Worley et al. | |
| 4,275,842 | A | 6/1981 | Purton et al. | |
| 4,335,733 | A | 6/1982 | Richards | |
| 4,410,398 | A | 10/1983 | Chipman et al. | |
| RE31,439 | E | 11/1983 | Rosensweig | |
| 4,492,103 | A | 1/1985 | Naumann | |
| 4,531,539 | A | 7/1985 | Jandrasi et al. | |
| 4,611,613 | A | 9/1986 | Kaplan | |
| 4,626,320 | A | 12/1986 | Alworth et al. | |
| 4,666,585 | A | 5/1987 | Figgins et al. | |
| 4,726,109 | A | 2/1988 | Malsbury et al. | |
| 4,738,399 | A | 4/1988 | Adams | |
| 4,771,805 | A | 9/1988 | Maa | |
| 4,797,197 | A | 1/1989 | Mallari | |
| 4,824,016 | A | 4/1989 | Cody et al. | |
| 4,877,488 | A | 10/1989 | Cody et al. | |
| 4,923,021 | A | 5/1990 | Courmier et al. | |
| 4,929,339 | A | 5/1990 | Elliott, Jr. et al. | |
| 4,960,358 | A | 10/1990 | Digiacomo et al. | |
| 4,973,386 | A | 11/1990 | Callegari et al. | |
| 4,993,264 | A | 2/1991 | Cody et al. | |
| 5,004,152 | A | 4/1991 | Baker et al. | |
| 5,022,266 | A | 6/1991 | Cody et al. | |
| 5,022,268 | A | 6/1991 | Wolf et al. | |
| 5,024,730 | A | 6/1991 | Colvert | |
| 5,035,221 | A | 7/1991 | Martin | |
| 5,041,207 | A | 8/1991 | Harrington et al. | |
| 5,048,876 | A | 9/1991 | Wallskog | |
| 5,059,331 | A | 10/1991 | Goyal | |
| 5,107,873 | A | 4/1992 | Clinger | |
| 5,116,022 | A | 5/1992 | Genreith et al. | |
| 5,221,019 | A | 6/1993 | Pechacek et al. | |
| 5,228,525 | A | 7/1993 | Denney et al. | |
| 5,228,825 | A | 7/1993 | Fruchtbaum et al. | |
| 5,299,841 | A | 4/1994 | Schaefer | |
| 5,417,811 | A | 5/1995 | Malsbury | |
| H1442 | H | 6/1995 | Edgerton et al. | |
| 5,464,035 | A | 11/1995 | Heinecke | |
| 5,581,864 | A | 12/1996 | Rabet | |
| 5,633,462 | A | 5/1997 | Heaslip et al. | |
| 5,652,145 | A | 7/1997 | Cody et al. | |
| 5,785,843 | A | 7/1998 | Antalffy et al. | |
| 5,800,680 | A | 9/1998 | Guerra | |
| 5,816,505 | A * | 10/1998 | Tran et al. | 239/443 |
| 5,816,787 | A | 10/1998 | Brinkerhoff | |
| 5,876,568 | A | 3/1999 | Kindersley | |
| 5,907,491 | A | 5/1999 | Canada et al. | |
| 5,927,684 | A | 7/1999 | Marx et al. | |
| 5,947,674 | A | 9/1999 | Malsbury et al. | |
| 5,974,887 | A | 11/1999 | Cody et al. | |
| 6,007,068 | A | 12/1999 | Dellacorte | |
| 6,039,844 | A | 3/2000 | Malik | |
| 6,066,237 | A | 5/2000 | Kindersley | |
| 6,113,745 | A | 9/2000 | Maitland et al. | |
| 6,117,308 | A | 9/2000 | Gangi | |
| 6,223,925 | B1 | 5/2001 | Malsbury et al. | |
| 6,228,225 | B1 | 5/2001 | Meher-Homji | |
| 6,254,733 | B1 | 7/2001 | Lu et al. | |
| 6,264,797 | B1 | 7/2001 | Schroeder et al. | |
| 6,264,829 | B1 | 7/2001 | Antalffy et al. | |
| 6,367,843 | B1 | 4/2002 | Fetzer | |
| 6,539,805 | B2 | 4/2003 | Heaslip et al. | |
| 6,547,250 | B1 | 4/2003 | Noble et al. | |
| 6,565,714 | B2 | 5/2003 | Lah | |
| 6,644,436 | B2 | 11/2003 | Hofmann et al. | |
| 6,644,567 | B1 * | 11/2003 | Adams et al. | 239/566 |
| 6,660,131 | B2 | 12/2003 | Lah | |
| 6,738,697 | B2 | 5/2004 | Breed | |
| 6,751,852 | B2 | 6/2004 | Malsbury et al. | |
| 6,843,889 | B2 | 1/2005 | Lah | |
| 6,926,807 | B2 | 8/2005 | Bosi et al. | |
| 6,964,727 | B2 | 11/2005 | Lah | |
| 6,989,081 | B2 | 1/2006 | Lah | |
| 7,033,460 | B2 | 4/2006 | Lah | |
| 7,037,408 | B2 * | 5/2006 | Wilborn et al. | 201/2 |
| 7,115,190 | B2 | 10/2006 | Lah | |
| 7,117,959 | B2 * | 10/2006 | Lah | 175/67 |
| 7,316,762 | B2 | 1/2008 | Lah | |
| 7,473,337 | B2 * | 1/2009 | Lah | 202/239 |
| 7,815,775 | B2 * | 10/2010 | Phillips et al. | 201/1 |
| 7,819,343 | B2 * | 10/2010 | Paul et al. | 239/446 |
| 7,820,014 | B2 * | 10/2010 | Lah | 201/2 |
| 7,828,959 | B2 * | 11/2010 | Ganji | 208/50 |
| 2002/0134658 | A1 | 9/2002 | Lah | |
| 2002/0157897 | A1 | 10/2002 | Hofmann et al. | |
| 2002/0166862 | A1 | 11/2002 | Malsbury et al. | |
| 2002/0170814 | A1 | 11/2002 | Lah | |
| 2003/0047153 | A1 | 3/2003 | Kubel et al. | |
| 2003/0089589 | A1 | 5/2003 | Malsbury | |
| 2003/0127314 | A1 | 7/2003 | Bell et al. | |
| 2003/0159737 | A1 | 8/2003 | Stares | |
| 2003/0185718 | A1 | 10/2003 | Sellakumar | |
| 2004/0118746 | A1 | 6/2004 | Wilborn et al. | |
| 2004/0154913 | A1 | 8/2004 | Lah | |

FOREIGN PATENT DOCUMENTS

| | | |
|---|---|---|
| RU | 2163359 C1 | 2/2001 |
| SU | 558524 | 3/1984 |
| SU | 558524 A | 3/1984 |
| SU | 959413 | 3/1984 |
| SU | 959413 A | 3/1984 |
| WO | 0015985 | 3/2000 |

OTHER PUBLICATIONS

U.S. Appl. No. 10/731,874, Final Rejection issued Jun. 28, 2005 by the United States Patent and Trademark Office. pp. 1-7.

U.S. Appl. No. 10/731,874, Examiner's search and strategy results issued Sep. 26, 2005. 1 page.

U.S. Appl. No. 10/731,874, Notice of Allowance of Fees Due, Issue Information, Index of Claims and Search information issued Sep. 29, 2005 by the United States Patent and Trademark Office; 7 pages.

U.S. Appl. No. 10/731,874, Notice of Allowance of Fees Dues, List of References, Issue Information, Search information and index of claims issued Jan. 18, 2006 by the United States Patent and Trademark Office; 10 pages.

U.S. Appl. No. 10/731,874, Non-Final Rejection issued Oct. 13, 2006 by the United States Patent and Trademark Office; 22 pages.

U.S. Appl. No. 10/731,874, Non-Final Rejection issued Apr. 6, 2007 by the United States Patent and Trademark Office; 14 pages.

U.S. Appl. No. 10/731,874, Requirement for Restriction/Election, List of References and index of claims issued Sep. 6, 2007 by the United States Patent and Trademark Office; 20 pages.

U.S. Appl. No. 10/731,874, Examiner's search strategy and results issued Dec. 5, 2007, 1 page.

U.S. Appl. No. 10/731,874, Non-Final Rejection issued Dec. 11, 2007 by the United States Patent and Trademark Office; 22 pages.

U.S. Appl. No. 10/997,834, Examiner's search strategy and results issued Jun. 22, 2005; 5 pages.

U.S. Appl. No. 10/997,834, Non-Final Rejection issued Jul. 6, 2005 by the United States Patent and Trademark Office; 44 pages.

U.S. Appl. No. 10/997,834, Examiner's search strategy and results issued Sep. 26, 2005; 1 page.

U.S. Appl. No. 10/997,834, Notice of Allowance and Fees, Issue Information, Index of Claims and search information issued Sep. 29, 2005 by the United States Patent and Trademark Office; 8 pages.

U.S. Appl. No. 10/411,849, Examiner's search strategy and results issued Aug. 4, 2005; 5 pages.

U.S. Appl. No. 10/411,849, Non-Final Rejection issued Aug. 9, 2005 by the United States Patent and Trademark Office; 8 pages.

(56) References Cited

OTHER PUBLICATIONS

U.S. Appl. No. 10/411,849, Non-Final Rejection issued Feb. 8, 2006 by the United States Patent and Trademark Office; 7 pages.
U.S. Appl. No. 10/411,849, Examiner's search strategy and results issued Jul. 18, 2006; 1 page.
U.S. Appl. No. 10/411,849, Notice of Allowance and Fees Due, Examiner Interview Summary Record, Issue Information, Index of Claims, Search Information and Bibliographic Data Sheet issued Jul. 24, 2006 by the United States Patent and Trademark Office; 14 pages.
U.S. Appl. No. 10/997,234, Examiner's search strategy and results issued Mar. 14, 2006; 3 pages.
U.S. Appl. No. 10/997,234, Non-Final Rejection issued Mar. 20, 2006 by the United States Patent and Trademark Office, 13 pages.
U.S. Appl. No. 10/997,234, Examiner's search strategy and results issued Aug. 4, 2006; 1 page.
U.S. Appl. No. 10/997,234, Notice of Allowance and Fees Due, Issue Information, Bibliographic Data Sheet, Index of Claims and Search Information issued Aug. 10, 2006 by the United States Patent and Trademark Office, 8 pages.
U.S. Appl. No. 10/412,628, Non-Final Rejection issued Feb. 16, 2007 by the United States Patent and Trademark Office; 17 pages.
U.S. Appl. No. 10/412,628, Notice of Allowance and Fees Due, Bibliographic Data Sheet, Index of Claims, Search Information and Issue Information issued Aug. 24, 2007 by the United States Patent and Trademark Office; 11 pages.
U.S. Appl. No. 10/873,022, Non-Final Rejection issued Jul. 7, 2005 by the United States Patent and Trademark Office, 12 pages.
U.S. Appl. No. 10/873,022, Notice of Allowance and Fees Due, Specification and Issue Information issued Jan. 4, 2006 by the United States Patent and Trademark Office, 9 pages.
U.S. Appl. No. 10/274,280, Examiner's search strategy and results issued Mar. 14, 2004; 2 pages.
U.S. Appl. No. 10/274,280, Non-Final Rejection issued Mar. 25, 2004 by the United States Patent and Trademark Office; 10 pages.
U.S. Appl. No. 10/274,280, Notice of Allowance and Fees Due, Issue Information and Bibliographic Data Sheet issued Oct. 5, 2004 by the United States Patent and Trademark Office; 8 pages.
U.S. Appl. No. 10/442,673, Examiner's search strategy and results issued Aug. 26, 2004, 2 pages.
U.S. Appl. No. 10/442,673, Non-Final Rejection issued Sep. 1, 2004 by the United States Patent and Trademark Office; 10 pages.
U.S. Appl. No. 10/442,673, Final Rejection issued Feb. 23, 2005 by the United States Patent and Trademark Office; 6 pages.
U.S. Appl. No. 10/442,673, Notice of Allowance and Fees Due, Amendment After Final, Issue Information, Index of Claims and Search Information issued Apr. 20, 2005 by the United States Patent and Trademark Office; 10 pages.
Zappe, R.W., Valve Selection Handbook, Fourth Edition, Gulf Publishing Company, Houston, Texas.
J. J. Kelley, "Applied Artificial Intelligence for Delayed Coking", Hydrocarbon Processing, Nov. 2000, 144-A-144-J, Gulf Publishing Company, USA.
Claudio Allevato & Richard S. Boswell, "Assessing the Structural Integrity and Remaining Life of Coke Drums with Acoustic Emission Testing, Stain Gaging, and Finite Element Analysis," ETCE 99—Symposium on Plant and Facilities Reliability and Mechanical Integrity, 1999 Engineering Source Technology Conference & Exhibition, Stress Engineering Services, Inc.
Norm Lieberman, "Coke Drum Foam-Overs Causes & Cures," http://www.coking.com/Foamover.htm, No Date.
Paul J. Ellis & Christopher A. Paul, "Tutorial: Delayed Coking Fundamentals," AIChE 1998 Spring National Meeting's International Conference on Refinery Processes Topical Conference Preprints 1998, 1998, Great Lakes Carbon Corporation.

* cited by examiner

REMOTELY CONTROLLED DECOKING TOOL USED IN COKE CUTTING OPERATIONS

RELATED APPLICATIONS

This application is a continuation in part of U.S. patent application Ser. No. 11/245,384, filed Oct. 6, 2005, entitled "Remotely Controlled Decoking Tool Used in Coke Cutting Operations", now U.S. Pat. No. 7,473,337 which is a continuation in part of U.S. patent application Ser. No. 10/997,234 now U.S. Pat. No. 7,117,959, filed Nov. 24, 2004, which claims priority to U.S. Provisional Patent Application Ser. No. 60/564,449, filed Apr. 22, 2004.

FIELD OF INVENTION

The present invention relates to a system for removing solid carbonaceous residue (hereinafter referred to as "coke") from large cylindrical vessels called coke drums. More particularly, the present invention relates to a system that allows an operator to remotely switch between cutting and boring within a coke drum.

BACKGROUND

Petroleum refining operations in which crude oil is processed to produce gasoline, diesel fuel, lubricants and so forth, frequently produce residual oils. The residual oil may be processed to yield valuable hydrocarbon products utilizing a delayed coker unit. When processed in a delayed coker residual oil is heated in a furnace to a temperature sufficient to cause destructive distillation in which a substantial portion of the residual oil is converted, or "cracked" to usable hydrocarbon products and the remainder yields petroleum coke, a material composed mostly of carbon.

Generally, the delayed coking process involves heating the heavy hydrocarbon feed from a fractionation unit, then pumping the heated heavy feed into a large steel vessel commonly known as a coke drum. The unvaporized portion of the heated heavy feed settles out in the coke drum, where the combined effect of retention time and temperature cause the formation of coke. Vapors from the top of the coke vessel are returned to the base of the fractionation unit for further processing into desired light hydrocarbon products. Normal operating pressures in coke drums during decoking range from twenty-five to fifty p.s.i. Additionally, the feed input temperature may vary between 800° F. and 1000° F.

The structural size and shape of coke drums vary considerably from one installation to another. However, coke drums are generally large, upright, cylindrical, metal vessels ninety to one-hundred feet in height, and twenty to thirty feet in diameter. Coke drums have a top head and a bottom portion fitted with a bottom head. Coke drums are usually present in pairs so that they can be operated alternately. Coke settles out and accumulates in a vessel until it is filled, at which time the heated feed is switched to the alternate empty coke drum. While one coke drum is being filled with heated residual oil, the other vessel is being cooled and purged of coke.

Coke removal, also known as decoking, begins with a quench step in which steam, then water are introduced into the coke filled vessel to complete the recovery of volatile, light hydrocarbons and to cool the mass of coke respectively. After a coke drum has been filled, stripped and quenched, the coke is in a solid state and the temperature is reduced to a reasonable level. Quench water is then drained from the drum through piping to allow for safe unheading of the drum. The drum is then vented to atmospheric pressure when the bottom opening is unheaded, to permit removing coke. Once the unheading is complete, the coke in the drum is cut out of the drum by high pressure water jets.

Decoking is accomplished at most plants using a hydraulic system comprised of a drill stem and drill bit that direct high pressure water into the coke bed. A rotating combination drill bit, referred to as the cutting tool, is typically about twenty two inches in diameter with several nozzles, and is mounted on the lower end of a long hollow drill stem about seven inches in diameter. The drill bit is lowered into the vessel, on the drill stem, through an opening at the top of the vessel. A "bore hole" is drilled through the coke using the nozzles, which eject high pressure water at an angle approximately 66 degrees down from horizontal. This creates a pilot bore hole, about two to three feet in diameter, for the coke to fall through.

After the initial bore hole is complete, the drill bit is then mechanically switched to at least two horizontal nozzles in preparation for cutting the "cut" hole, which extends to the full drum diameter. In the cutting mode the nozzles shoot jets of water horizontally outwards, rotating slowly with the drill rod, and those jets cut the coke into pieces, which fall out the open bottom of the vessel, into a chute that directs the coke to a receiving area. The drill rod is then withdrawn out the flanged opening at the top of the vessel. Finally, the top and bottom of the vessel are closed by replacing the head units, flanges or other closure devices employed on the vessel unit. The vessel is then clean and ready for the next filling cycle with the heavy hydrocarbon feed.

After the boring hole is made, the drill stem must be removed from the coke drum and reset to the cutting mode. This takes time, is inconvenient and is potentially hazardous if the hydro-cutting system is not shut off before the drill stem is raised out of the top drum opening, operators are exposed to the high-pressure water jet and serious injuries including dismemberment occur.

In other systems the modes are automatically switched. Often, in automatic switching systems, it is difficult to determine whether or not the drill stem is in cutting or boring mode, because the entire change takes place within the drum. Mistakes in identifying whether the high pressure water is cutting or boring often occur when a cutting tool fails to switch between cutting and boring modes, which may lead to serious accidents. Thus, coke-cutting efficiency is compromised because the switching operator does not know whether or not the cutting process is complete.

SUMMARY AND OBJECTS OF THE INVENTION

These and other features and advantages of the present invention will be set forth or will become more fully apparent in the description that follows and in the appended claims. The features and advantages may be realized and obtained by means of the instruments and combinations particularly pointed out in the appended claims. Furthermore, the features and advantages of the invention may be learned by the practice of the invention or will be obvious from the description, as set forth hereinafter.

Some embodiments of the invention comprise a drill stem coupled to a cutting tool wherein the drill stem allows for the movement of fluids through the interior of the drill stem to the cutting tool. In some embodiments, the cutting tool comprises cutting nozzles and boring nozzles. In some embodiments the drill stem directs high pressure fluids through the interior of the drill stem to the cutting tool and out the boring nozzles.

Alternatively, fluids may be directed through the drill stem to the cutting head and out the cutting nozzles.

In some embodiments, the invention comprises a flow diversion apparatus which directs the flow of liquid either into the boring nozzles or the cutting nozzles.

In other embodiments, the flow diversion apparatus is comprised of a main body, a flow diversion cap and a shifting apparatus.

In some embodiments of the present invention, the shifting apparatus is coupled to the flow diversion apparatus such that the shifting apparatus facilitates the movement of the flow diversion apparatus so that the flow of fluid through the drill stem into the cutting head can be directed to either the cutting nozzles or the boring nozzles depending on the position of the flow diversion apparatus.

The present invention relates to a system for removing solid carbonaceous residue, referred to as "coke," from large cylindrical vessels called coke drums. The present invention relates to a system that allows an operator to remotely activate the cutting of coke within a coke drum, and to remotely switch between the "boring" and the "cutting" modes, while cutting coke within a coke drum reliably, and without raising the drill bit out of the coke drum for mechanical alteration or inspection. Hence, the present invention provides a system for cutting coke within a coke drum with increased safety, efficiency and convenience.

BRIEF DESCRIPTION OF THE DRAWINGS

In order that the manner in which the above recited and other features and advantages of the present invention are obtained, a more particular description of the invention will be rendered by reference to specific embodiments thereof, which are illustrated in the appended drawings. Understanding that the drawings depict only typical embodiments of the present invention and are not, therefore, to be considered as limiting the scope of the invention, the present invention will be described and explained with additional specificity and detail through the use of the accompanying drawings in which.

DETAILED DESCRIPTION OF THE PREFERRED EMBODIMENTS

Figure 1:
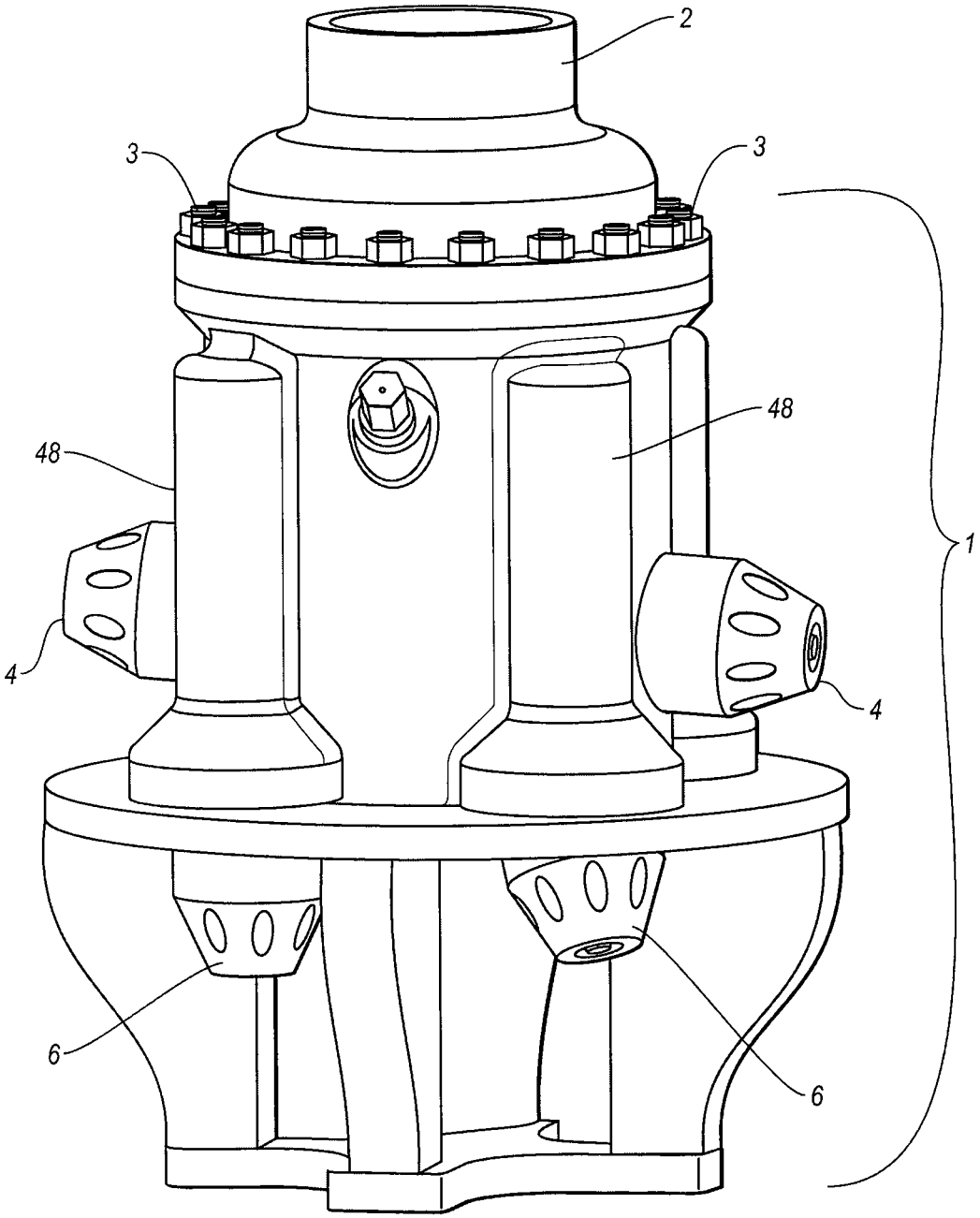
FIG. 1 is an illustration of a drill stem coupled to a cutting tool.

The present invention relates to a system for removing coke from coke drums. This removal process is often referred to as "decoking." More particularly, the present invention relates to a system that allows an operator to remotely switch a cutting tool between the boring and cutting modes.

The presently preferred embodiments of the invention will be best understood by reference to the drawings wherein like parts are designated by like numerals throughout. Further the following disclosure of the present invention is grouped into two subheadings, namely "Brief General Discussion on Delayed Coking and Coke-Cutting" and "Detailed Description of the Present Invention." The utilization of the subheadings is for convenience of the reader only and is not to be construed as limiting in any sense.

It will be readily understood that the components of the present invention, as generally described and illustrated in the figures herein, could be arranged and designed in a wide variety of different configurations. Thus, the following more detailed description of the embodiments of the system, device and method of the present invention, and represented in FIGS. 1 through 6, is not intended to limit the scope of the invention, as claimed, but is merely representative of the presently preferred embodiments of the invention.

1. Brief General Discussion on Delayed Coking and Coke-Cutting

In the typical delayed coking process, high boiling petroleum residues are fed into one or more coke drums where they are thermally cracked into light products and a solid residue-petroleum coke. The coke drums containing the coke are typically large cylindrical vessels. The decoking process is a final process in the petroleum refining process and, once a process known as "de-heading" has taken place, the coke is removed from these drums by coke-cutting means.

In the typical delayed coking process, fresh feed and recycled feed are combined and fed through a line from the bottom of the fractionator. The combined feed is pumped through a coke heater and heated to a temperature between about 800° F. to 1000° F. The combined feed is partially vaporized and alternatively charged into a pair of coker drums. Hot vapor expelled from the top of the coke drum are recycled to the bottom of the fractionator by a line. The unvaporized portion of the coke heater effluent settles out ("cokes") in an active coke drum, where the combined effect of temperature and retention time result in coke until the active vessel is full. Once the active vessel is full the heated heavy hydrocarbon feed is redirected to an empty coker vessel where the above described process is repeated. Coke is then removed from the full vessel by first quenching the hot coke with steam and water, then opening a closure unit sealed to the vessel top, hydraulically drilling the coke from the top portion of the vessel, directing the drilled coke from the vessel through an open coker bottom unit through an attached coke chute to a coke receiving area. Opening the closure unit is safely accomplished by a remotely located control unit.

Decoking is accomplished at most plants using a hydraulic system consisting of a drill stem and drill bit that direct high pressure water jets into the coke bed. A rotating combination drill bit, referred to as the cutting tool, is typically about twenty two inches in diameter with several nozzles, and is mounted on the lower end of a long hollow drill stem about seven inches in diameter. The drill bit is lowered into the vessel, on the drill stem, through a flanged opening at the top of the vessel. A "bore hole" is drilled through the coke using the nozzles, which eject high pressure water at an angle approximately sixty six degrees down from horizontal. This creates a pilot bore hole, about two to three feet in diameter, for the coke to fall through.

After the initial bore hole is complete, the drill bit is then switched to at least two horizontal nozzles in preparation for cutting the "cut" hole, which extends to the full drum diameter. In the cutting mode the nozzles shoot jets of water horizontally outwards, rotating slowly with the drill rod, and those jets cut the coke into pieces, which fall out the open bottom of the vessel, into a chute that directs the coke to a receiving area. The drill rod is then withdrawn out the flanged opening at the top of the vessel. Finally, the top and bottom of the vessel are closed by replacing the head units, flanges or other closure devices employed on the vessel unit. The vessel is then clean and ready for the next filling cycle with the heavy hydrocarbon feed.

In some coke-cutting system, after the boring hole is made, the drill stem must be removed from the coke drum and reset to the cutting mode. This takes time, is inconvenient and potentially hazardous. In other systems the modes are automatically switched. Automatic switching within the coke drum oftentimes results in drill stem clogging, which still requires the drill stem to be removed for cleaning prior to completing the coke-cutting process. Often, in automatic switching systems, it is difficult to determine whether or not the drill stem is in cutting or boring mode, because the entire change takes place within the drum. Mistakes in identifying whether the high pressure water is cutting or boring leads to serious accidents The present invention describes a method and system for coke-cutting in a coke drum following the manufacturing of coke therein. As the present invention is especially adapted to be used in the de-coking process, the following discussion relates specifically to this manufacturing area. It is foreseeable, however, that the present invention may be adapted to be an integral part of other manufacturing processes producing various elements other than coke, and such processes should thus be considered within the scope of this application.

2. Detailed Description of Present Invention

Accordingly, it is an object of some embodiments of the present invention to provide a system for cutting coke that is controlled from a remote location through an automatic switching mechanism. The present invention provides a system for coke-cutting wherein the drill stem 2 does not need to be removed to change from boring to cutting mode, but rather, modes can be changed remotely. The present invention provides for a method for coke-cutting wherein the drill stem does not need to be removed to change between the boring and cutting modes. The present invention provides systems and methods for coke-cutting can be used with current coke-cutting techniques.

FIG. 1 illustrates a drill stem coupled to a cutting tool 1 by an attachment means 3. The drill stem and cutting tool depicted in FIG. 1 are utilized in some embodiments of the present invention to remove coke from a coke drum. FIG. 1 further illustrates cutting nozzles 4 and boring nozzles 6. FIG. 1 further depicts a view of the exterior of the boring passage 48 which is a passage through which fluids flows between the drill stem and the boring nozzles in some embodiments of the invention. In some embodiments of the present invention, some passage ways which allow fluid to flow from the drill stem to the cutting nozzles are present inside the cutting tool.

Additionally depicted in FIG. 1, is an embodiment of means for cutting coke from the inside of a coke drum comprising a drill stem coupled to a cutting tool 1 by an attachment means 3. The drill stem and cutting tool depicted in FIG. 1 are utilized in some embodiments of the present invention to remove coke from a coke drum. FIG. 1 further illustrates cutting means comprising cutting nozzles 4 and boring nozzles 6.

Figure 2:
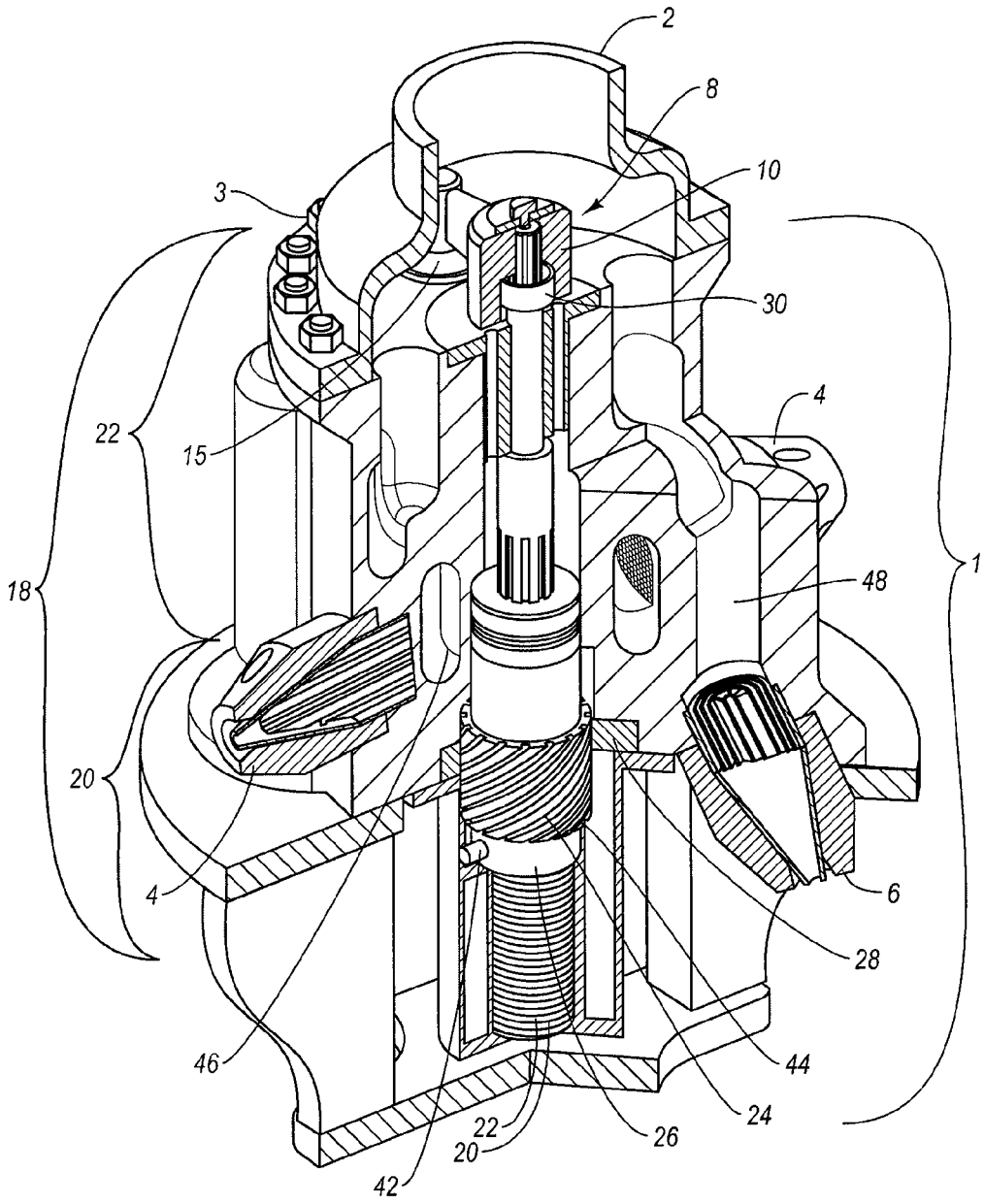
FIG. 2 illustrates a cutaway view of some embodiments of the present invention illustrating various internal components that may comprise some embodiments of the invention.

FIG. 2 illustrates a cutaway view of a cutting tool of some embodiments of the present invention. As previously mentioned, high pressure fluid is moved through a drill stem to cutting tool 1 and allowed to eject from either the boring nozzle 6 or cutting nozzle 4. In some embodiments, the systems and methods of the present invention allow for automatically switching the flow of fluid between the boring and cutting nozzles, such that an operator may remotely switch the flow of fluid being ejected from the cutting tool to eject either from the boring nozzles 6 or the cutting nozzles 4 alternatively as the decoking process dictates. For example, in some embodiments an operator utilizing systems and methods of the present invention may allow fluid to flow through the drill stem into the cutting tool 1 and out the boring nozzle 6 to produce a bore hole. In some embodiments the systems and methods of the present invention would allow an operator located at a remote position to stop the flow of fluid being ejected from the boring nozzle 6 and begin ejecting fluid from the cutting nozzles 4.

FIG. 2 illustrates several of the elements of the systems of some embodiments of the present invention. FIG. 2 depicts a drill stem coupled by an attachment means 3 to a cutting tool 1. The cutting tool as depicted in FIG. 2 is comprised of several elements. The cutting tool depicted in FIG. 2 is comprised of nozzles for cutting 4 and nozzles for boring 6. In some embodiments of the cutting tool, the internal chambers of the cutting tool comprise channels through which fluid may flow from the drill stem into the cutting tool and into either the boring 6 or cutting 4 nozzles. In some embodiments of the invention, a flow diversion apparatus 8 is utilized to selectively allow the movement of fluid into the cutting nozzles 4 or into the boring 6 nozzles. More particularly in some embodiments of the present invention, the flow diversion apparatus 8 blocks water from flowing into passage ways which lead to the cutting nozzles 4 or the boring nozzles 4 such that fluid flowing through the cutting stem into the cutting tool 1 is allowed to flow only into the boring nozzles 6 or only into the cutting nozzles 4.

In some embodiments the flow diversion of the apparatus 8 of the present invention is comprised of a main body 10 of the flow diversion apparatus 8 and flow diversion caps 14 wherein the main body 10 of the flow diversion apparatus 8 is coupled to the flow diversion caps 14, such that the rotation of the main body 10 of the flow diversion apparatus 8 shifts the position of the flow diversion caps 14 in a rotational axes. The flow diversion caps 14 coupled to the main body 10 of the flow diversion of the apparatus 8 are biased against the interior elements of the cutting tool by a force applicator 12 contained within the main body 10 of the flow diversion apparatus 8, such that the flow diversion caps 14 are biased against the interior elements of the cutting tool 1. In some embodiments, the flow diversion caps 14 are comprised of a beveled edge 15.

In some embodiments of the present invention, the beveled edge 15 acts to seal the passage ways over which the flow diversion cap 14 is present. In some embodiments, high pressure fluids flowing through the drill stem 2 into the cutting tool 1 push against the top edge of the beveled edge 15 forcing the beveled edge 15 of the flow diversion cap 14 into contact with the internal elements of the cutting tool 1 such that fluid is unable to pass into a passage over which the flow diversion cap 14 is present.

Additionally, FIG. 2 illustrates an embodiment of a means for diverting the flow of fluid exclusively into a boring means or exclusively into a cutting means. The means for diverting the flow of fluid, in some embodiments comprises a main body 10 of a flow diversion apparatus 8 and flow diversion caps 14 wherein the main body 10 of the flow diversion apparatus 8 is coupled to the flow diversion caps 14, such that rotation of the main body 10 of the flow diversion apparatus 8 shifts the position of the flow diversion caps 14 in a rotational axes.

In some embodiments of the means for diverting flow of fluid the flow diversion caps 14 coupled to the main body 10 of the flow diversion of the apparatus 8 are bias against the interior elements of the cutting tool by a force applicator 12 contained within the main body 10 of the flow diversion apparatus 8, such that the flow diversion caps 14 are bias against the interior elements of the cutting tool 1. In some embodiments of the means for diverting flow of fluid, the flow diversion caps 14 are comprised of a beveled edge 15. In some embodiments of the means for diverting flow of fluid, the beveled edge 15 acts to seal the passage ways over which the flow diversion cap 14 is present. In some embodiments of the means for diverting flow of fluid, high pressure fluids flowing through the drill stem 2 into the cutting tool 1 push against the top edge of the beveled edge 15 forcing the beveled edge 15 of the flow diversion cap 14 into contact with the internal elements of the cutting tool 1 such that fluid is unable to pass into a passage over which the flow diversion cap 14 is present.

In some embodiments of the present invention, the main body 10 of the flow diversion apparatus 8 is coupled to a shifting apparatus 8. In some embodiments of the present invention the shifting apparatus 18 rotates the flow diversion apparatus in 90 degree increments such that the flow diversion apparatus 8 is either blocking the flow of fluids into passage ways 48 which allow fluid to eject from the boring nozzles or is blocking passages 46 which allow fluid to flow into the cutting nozzles 4.

As depicted in FIG. 2 in some embodiments the shifting apparatus 18 is comprised of at least one spring 20 and preferably two springs 20, 22. In systems where two springs 20, 22 are utilized, the preferred method for aligning the springs relative to the shifting apparatus is to have an outside spring 20 and an inside spring 22 oriented such that the rotation of the outside spring 20 is in the opposite direction of the rotation of the inside spring 22 such that the tortional influence of the spring system 20, 22 on the bottom of the shifting apparatus 18 is minimized. In some embodiments, the springs 20, 22 of the shifting apparatus 18 contact the bottom of a helical spline 24 by a thrust bearing 26 which acts to decrease the rotational force exerted on the bottom of the helical spline 24. In some embodiments, the springs 20, 22 are biased against the interior element of the cutting tool 1 and against the bottom of the helical spline 24. In the absence of any downward force, the springs 20, 22 force the helical spline 24 vertically upwards from the bottom of the cutting tool 1.

Some embodiments of the present invention further comprise of a rotational ratcheting mechanism 28. In a preferred embodiment of the present invention two rotational ratcheting mechanism 28, 30 are utilized in opposite directions, one allowing clockwise rotation and the other allowing counter clockwise rotation. In some embodiments, the first rotational ratchet 28 is functionally connected to the helical spline 24. In some embodiments, the second rotational ratchet 30 is functionally connected to a vertically splined post 32. The double ratcheting mechanism of some embodiments of the present invention allow the shifting apparatus 18 to rotate the flow diversion apparatus 8 as depicted in FIG. 2 in a counterclockwise direction as the elements of the shifting apparatus 18 move in an upward direction, but allow the elements of the shifting apparatus 18 to move downwards without rotating the flow diversion apparatus 8 in a clockwise direction. Accordingly, in some embodiments of the present invention the first rotational ratchet 28 is locked as the helical spline 24 is moved upward, such that the helical spline 24 rotates in a counterclockwise direction as the helical spline 24 moves upward.

In some embodiments, as the helical spline 24 rotates in a counterclockwise direction, the vertical splines of the vertically splined post 32 operably interact with internal vertical splines of the helical spline 24 turning the vertically splined post in a counterclockwise direction. Because the vertically splined post 32 in some embodiments is coupled to the main body of the flow diversion apparatus 10, the flow diversion apparatus 8 is likewise rotated in a counterclockwise direction, and in preferred embodiments the flow diversion apparatus turns exactly 90 degrees such that the flow diversion caps 14, operably connected to the main body 10 of the flow diversion apparatus 8 shift from allowing fluid to flow into the boring nozzles, effectively covering the passage 46 of fluid into the cutting nozzles 4, into a position where fluid is allowed to flow into the cutting nozzles 4 and not into the boring nozzles 6.

In some embodiments when fluid is then reintroduced or the pressure of fluid is increased into the cutting tool 1 through the drill stem 2, fluid flows through the drill stem 2 into the cutting tool 1 and through small channels in the vertically splined post 32 such that the reintroduction of high pressure fluid into the cutting tool 1 moves through the small channels and applies force to the top of the helical spline 36. As force is applied to the top of the helical spline 36, the helical spline 24 is forced in a downward direction. When helical spline 24 is forced in a downward direction by the pressure of fluid introduced into the system, the first rotational ratchet 28 is allowed to free wheel such that the helical spline 24 is moved downward without rotating against the double spring bias system 20, 22. A second rotationally ratcheting mechanism 30 operably connected to the vertically splined nut 32 operates to lock the vertically splined nut 32 from rotating while the helical spline 24 moves in a downward direction.

In some embodiments of the present invention, the first rotational ratchet 28 is locked when the shifting apparatus 18 is moving upward under the absence of the water pressure forcing the helical spline 24 to rotate while the second rotational ratchet 30 is allowed to freewheel in a counterclockwise direction allowing the vertically splined post 32 of the shifting apparatus 18 to rotate is a counterclockwise direction. When water pressure is reintroduced into the system and the helical spline 24 moves in a downward direction the first rotational ratchet 28 is allowed to freewheel while the second rotational ratchet 30 is locked, preventing the rotation of the flow diversion apparatus during the downward movement of the helical spline 24.

Some embodiments of the present invention further comprise a rotational ratchet means 28. In a preferred embodiment of the present invention two rotational ratcheting means 28, 30 are utilized in opposite directions, one allowing clockwise rotation and the other allowing counter clockwise rotation. In some embodiments, the first rotational ratchet means 28 is functionally connected to the helical spline 24. In some embodiments, the second rotational ratchet means 30 is functionally connected to a vertically splined post 32. The double ratcheting mechanism of some embodiments of the present invention allow the shifting apparatus 18 to rotate the flow diversion apparatus 8 as depicted in FIG. 2 in a counterclockwise direction as the elements of the shifting apparatus 18 move in an upward direction, but allow the elements of the shifting apparatus 18 to move vertically downwards without rotating the flow diversion apparatus 8 in a clockwise direction.

Figure 3:
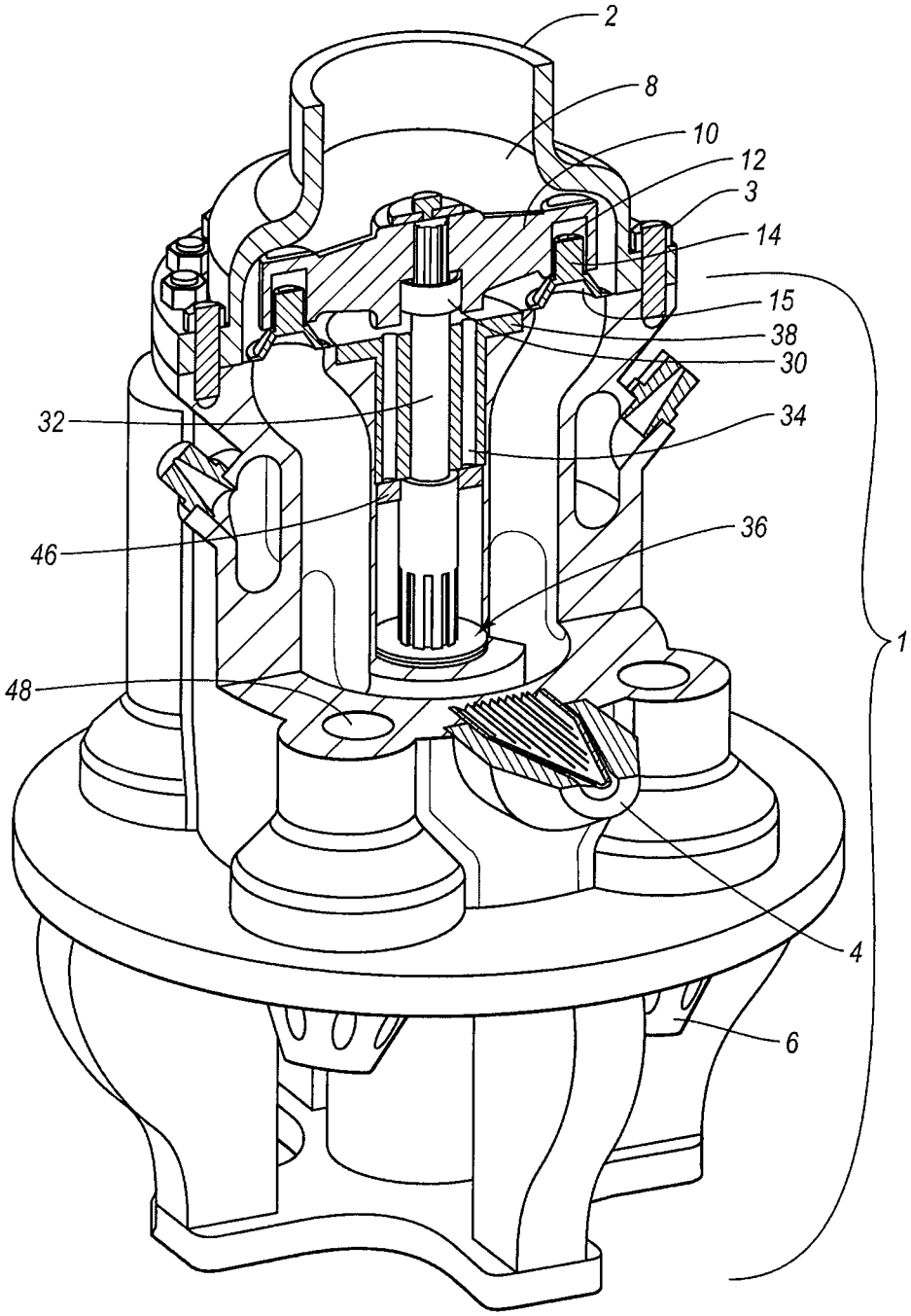
FIG. 3 is an additional illustration of a cutaway view of some embodiments of the present invention illustrating various internal components of some embodiments of the invention.

FIGS. 2 and 3 additionally illustrate an embodiment of the means for remotely shifting a diverting means between cutting and boring modes. In some embodiments the means for remotely shifting comprises at least one spring 20 and preferably two springs 20, 22. In systems where two springs 20, 22 are utilized, the preferred method for aligning the springs relative to the shifting apparatus is to have an outside spring 20 and an inside spring 22 oriented such that the rotation of the outside spring 20 is in the opposite direction of the rotation of the inside spring 22 such that the tortional influence of the spring system 20, 22 on the bottom of the shifting apparatus 18 is minimized.

In some embodiments of the means for remotely shifting a diverting means between cutting and boring modes, the springs 20, 22 of the shifting apparatus 18 contact the bottom of a helical spline 24 by a thrust bearing 26 which acts to decrease the rotational force exerted on the bottom of the helical spline 24. In some embodiments of the means for remotely shifting a diverting means between cutting and boring modes, the springs 20, 22 are biased against the interior element of the cutting tool 1 and against the bottom of the helical spline 24. In the absence of any downward force, the springs 20, 22 force the helical spline 24 vertically upwards from the bottom of the cutting tool 1.

Some embodiments of the means for remotely shifting a diverting means between cutting and boring modes further comprise a rotational ratcheting mechanism 28. In some embodiments, the first rotational ratchet 28 is functionally connected to the helical spline 24. In some embodiments of the means for remotely shifting a diverting means between cutting and boring modes, the second rotational ratchet 30 is functionally connected to a vertically splined post 32. The double ratcheting mechanism of some embodiments of the means for remotely shifting a diverting means between cutting and boring modes allow the shifting apparatus 18 to rotate the flow diversion means 8 as depicted in FIG. 2 in a counterclockwise direction as the elements of the shifting apparatus 18 move in an upward direction, but allow the elements of the shifting means 18 to move vertically downwards without rotating the flow diversion means 8 in a clockwise direction.

In some embodiments of the means for remotely shifting a diverting means between cutting and boring modes the first rotational ratchet 28 is locked as the helical spline 24 is moved in an upward direction such that the helical spline 24 rotates in a counterclockwise direction as the helical spline 24 moves in an upward direction. In some embodiments of the means for remotely shifting a diverting means between cutting and boring modes, as the helical spline 24 rotates in a counterclockwise direction, the vertical splines of the vertically splined post 32 operably interact with internal vertical splines of the helical spline 24 turning the vertically splined post in a counterclockwise direction. Because the vertically splined post 32 in some embodiments is coupled to the main body of the flow diversion means 10, the flow diversion means 8 is likewise rotated in a counterclockwise direction, and in preferred embodiments the flow diversion apparatus turns exactly 90 degrees such that the flow diversion caps 14, operably connected to the main body 10 of the flow diversion apparatus 8 shift from allowing fluid to flow into the boring nozzles, effectively covering the passage 46 of fluid into the cutting nozzles 4, into a position where fluid is allowed to flow into the cutting nozzles 4 and not into the boring nozzles 6.

In some embodiments of the means for remotely shifting a diverting means between cutting and boring modes, when fluid is then reintroduced or the pressure of fluid is increased into the cutting tool 1 through the drill stem 2, fluid flows through the drill stem 2 into the cutting tool 1 and through small channels in the vertically splined post 32 such that the reintroduction of high pressure fluid into the cutting tool 1 moves through the small channels and applies force to the top of the helical spline 36. As force is applied to the top of the helical spline 36, the helical spline 24 is forced in a downward direction. When helical spline 24 is forced in a downward direction by the pressure of fluid introduced into the system, the first rotational ratchet means 28 is allowed to free wheel such that the helical spline 24 is moved downward without rotating against the double spring bias system 20, 22. A second rotationally ratcheting means 30 operably connected to the vertically splined nut 32 operates to lock the vertically splined nut 32 from rotating while the helical spline 24 moves in a downward direction. Thus, in some embodiments of the means for remotely shifting a diverting means between cutting and boring modes, the first rotational ratchet means 28 is locked when the shifting means 18 is moving upward under the absence of the water pressure forcing the helical spline 24 to rotate while the second rotational ratchet 30 is allowed to freewheel in a counterclockwise direction allowing the vertically splined post 32 of the shifting means 18 to rotate is a counterclockwise direction. When water pressure is reintroduced into the system and the helical spline 24 moves in a downward direction the first rotational ratchet means 28 is allowed to freewheel while the second rotational ratchet means 30 is locked, preventing the rotation of the flow diversion means during the downward movement of the helical spline 24.

FIG. 3 depicts an embodiment of a cutting tool 1. FIG. 3 adds particularity to the operable relations that exist in some embodiments between the vertically splined post 32 and the main body of the fluid diversion apparatus 8. In some embodiments, the main body 10 of the fluid diversion apparatus 8 may be operably connected to the vertically splined post 32 by a set of vertical splines which translate the rotation of the vertically splined post 32 into the rotation of the main body 10 of the fluid diversion apparatus 8. FIG. 3 further illustrates an embodiment of the shifting apparatus collar 38. In some embodiments, the shifting apparatus collar 38 surrounds the vertically splined post 32 and holds the second rotational ratchet 30 against the vertically splined post 32. In some embodiments, the shifting collar 38 may be comprised of small channels 34, which allow fluids in the cutting head 1, to contact the top surface of the helical spline 36. In some embodiments, the shifting apparatus 38 also acts to support the bottom of the main body of the flow diversion apparatus 10 maintaining specific vertical tolerances within the body of the cutting tool 1.

FIG. 3 further illustrates a spring actuated system 12 utilized in some embodiments to apply a downward force to the flow diversion caps 14. The force applicator 12 in some embodiments of the present invention is comprised of a spring biased against the main body flow diversion of the apparatus 10 and the top of the flow diversion caps 14 such that the spring supplies a continual downward force on the flow diversion caps 14. Because the flow diversion caps, in some embodiments of the present invention, are pushed downward by the force applicator 12 consistently even through the rotationally shifting movements the bottom of the beveled edge 15 of the flow diversion caps 14 is polished by its radial movement across the main body of the cutting tool 1. This polishing effect increases the sealing capacity of the flow diversion caps over time. Thus, in some embodiments, the capacity for the switching tool to function does not decrease with time.

Figure 4:
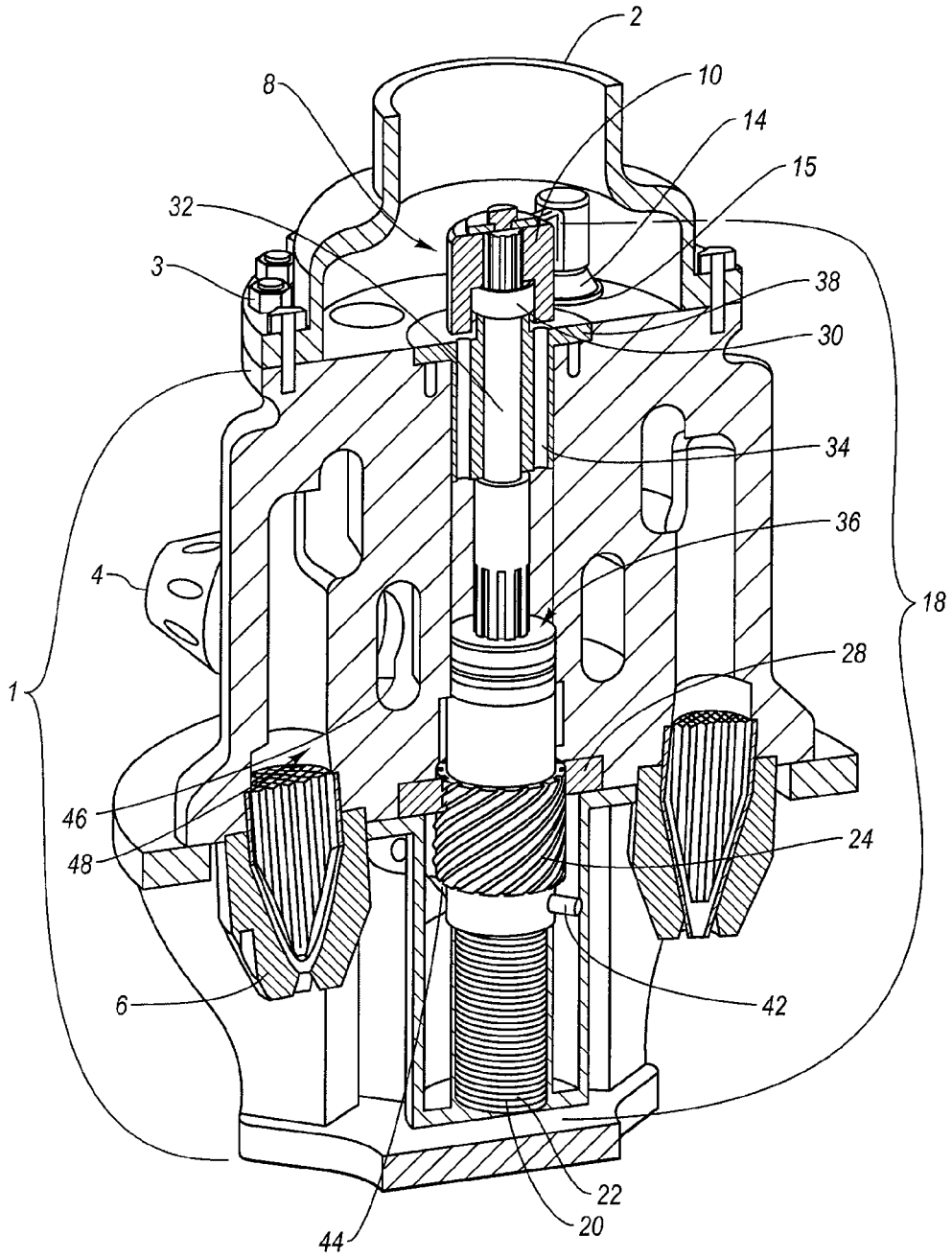
FIG. 4 is an additional illustration of a cutaway view of some embodiments of the present invention illustrating various components of which the present invention may be comprised.

FIG. 4 illustrates the use of an indexing key 42 which is one or more posts which extends from the body of the helical spline 24 and which operably interact with notches 44 either in the shifting apparatus 18 or in the main body of the cutting head itself 1. The indexing key 42 at the bottom of the shifting apparatus 18 ensures that the shifting apparatus 18 rotates to a precise rotational position such that the flow diversion caps 14 of the embodiments of the present invention align appropriately with the passageways which correspond to boring and cutting. The indexing key 42/notch 44 system for insuring appropriate rotational movement of the shifting apparatus 18 may or may not be utilized on any of the embodiments of the present invention.

Figure 5:
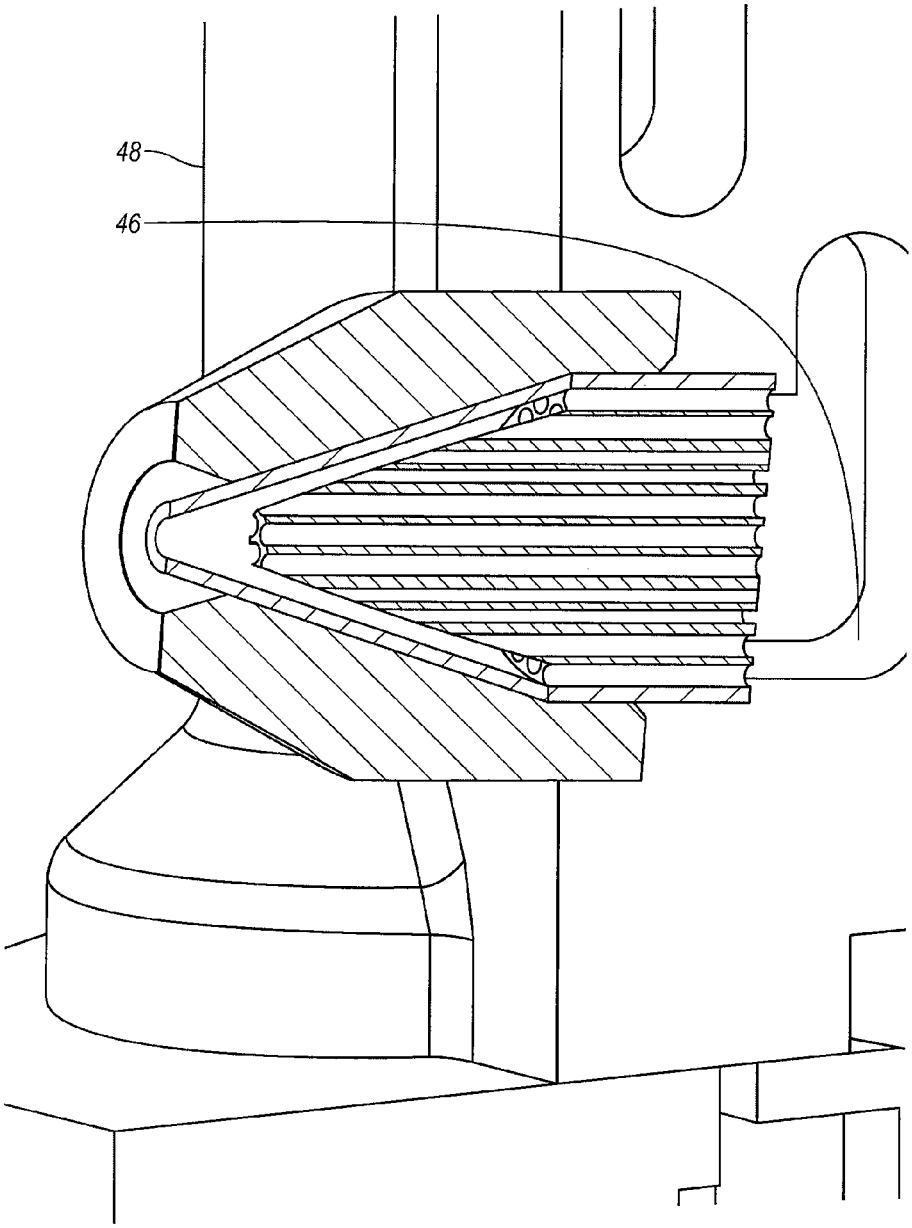
FIG. 5 illustrates a nozzle which may be utilized in some embodiments of the present invention.

FIG. 5 illustrates a nozzle which may be utilized in the present invention. The nozzle may be utilized as a boring nozzle 6 or a cutting nozzle 4. The depicted nozzle is coupled to the cutting tool 1 and allows fluid to flow from a cutting passage 46 or a boring passage 48 such that fluid introduced into the cutting tool 1, through the drill stem, 2 may be allowed to flow from the internal passages of the cutting tool 1 through the nozzle 4, 6 and utilize to cut coke from the coke drum. As depicted in FIG. 5, in some embodiments, the interior of the nozzle is characterized by a series of smaller straw like tubes. In some embodiments of the present invention, the length of the straw-like tubes are modified to maximize the laminar flow of the fluids exiting the nozzle 4, 6. Thus in some embodiments of the present invention, the laminar flow of fluid exiting the boring 6 or cutting nozzles 4 is increased thereby increasing the efficiency of the boring or cutting steps of the coke in the drum.

Figure 6:
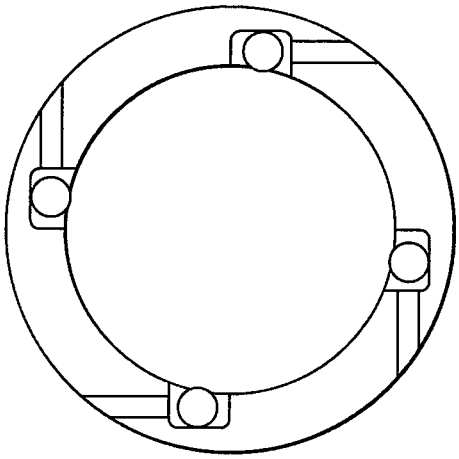
FIG. 6 illustrates an embodiment of a rotational ratcheting mechanism which may be utilized in some embodiments of the present invention.
Figure 6A:
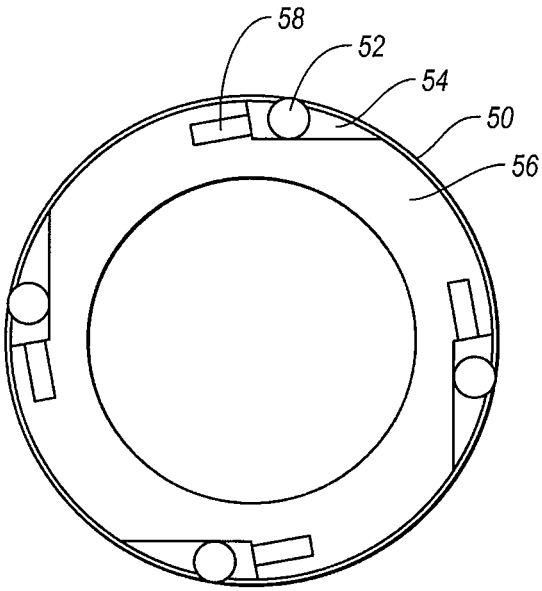
FIGS. 6*a* and 6*b* illustrate an embodiment of a rotational ratcheting mechanism which may be utilized in some embodiments of the present invention.
Figure 6B:
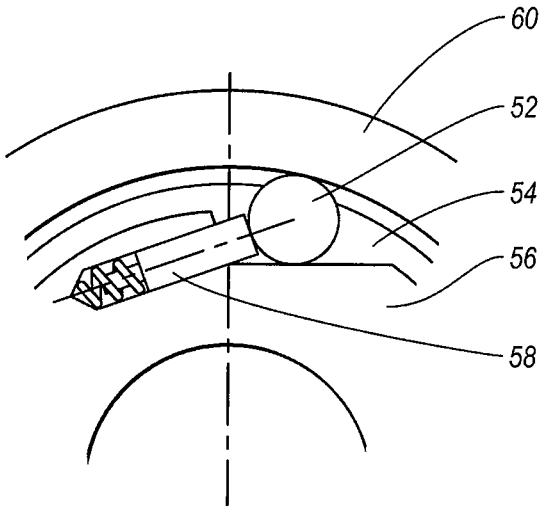

FIGS. 6*a* and 6*b* depict preferred embodiments of the first and second rotational ratchet 28, of the present invention. In some embodiments, the rotational ratchet(s) of the present invention may be comprised of an outer race 50, a locking roller 52, and guide disk 54, an inter race 56 and a spring loaded plunger 58.

Figure 7:
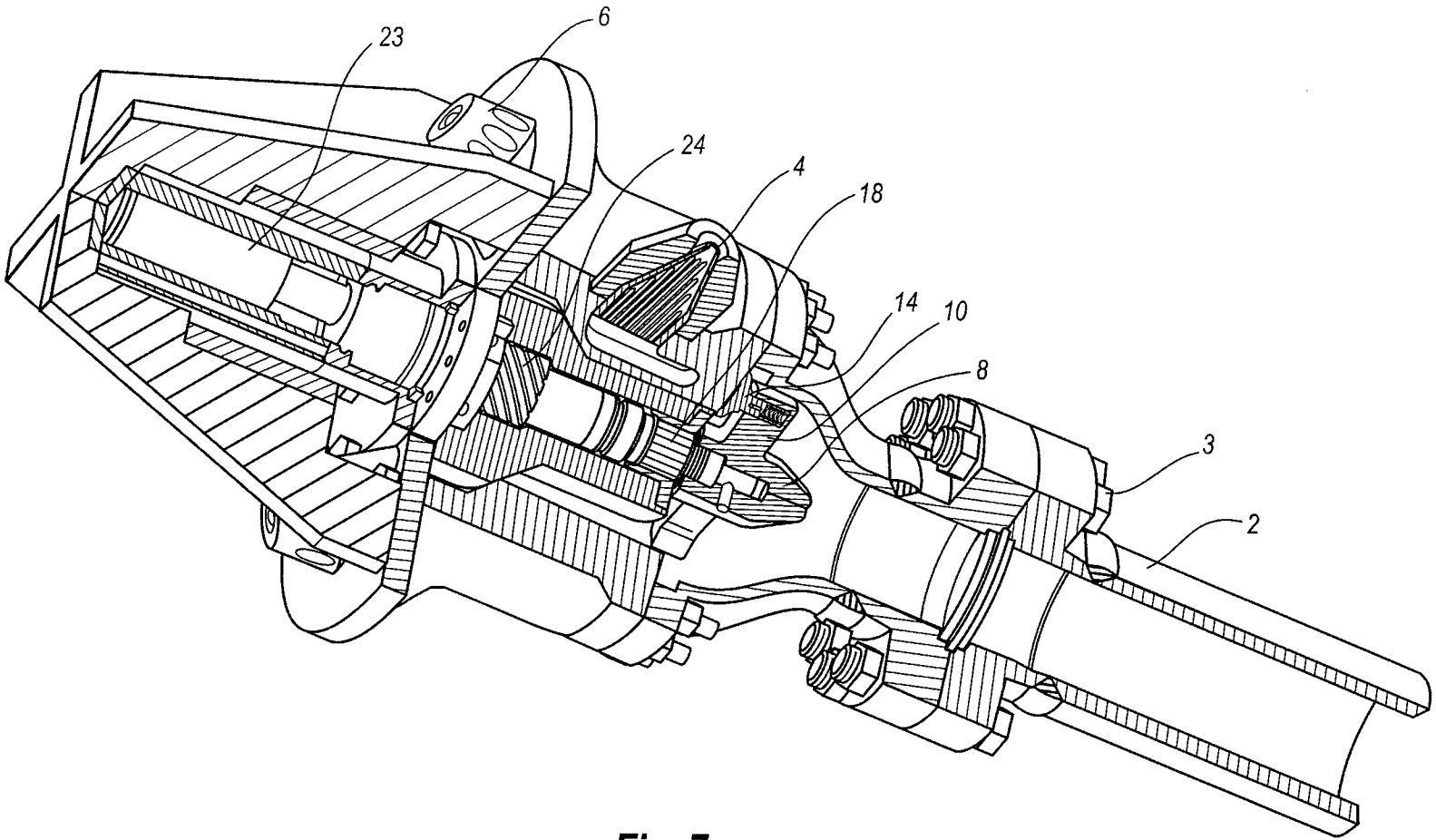
FIG. 7 illustrates an embodiment of a cutting tool particularly depicting the use of a nitrogen spring.

FIG. 7 depicts an embodiment of the cutting tool of the present invention. In particular, FIG. 7 adds specificity to an additional embodiment of a spring system which may be utilized to move the shifting apparatus 18 vertically. FIG. 7 depicts a nitrogen spring 23 which may be utilized in preferred embodiments of the present invention. In preferred embodiments the nitrogen spring is comprised of a high pressure inert gas contained within a chamber which is used to apply an upward force on the bottom of the helical spline 24. In preferred embodiments the pressure within the nitrogen spring is carefully calculated so that the upward and downward movement of the helical spline 24 will occur at designated and predetermined pressures. In some embodiments the nitrogen spring 23 provides additional benefits of more consistent pressure being exerted on the bottom of the shifting apparatus. Accordingly, the nitrogen spring 23 as depicted in FIG. 7 may be utilized to allow smoother shifting between the boring and cutting mode.

Figure 8:
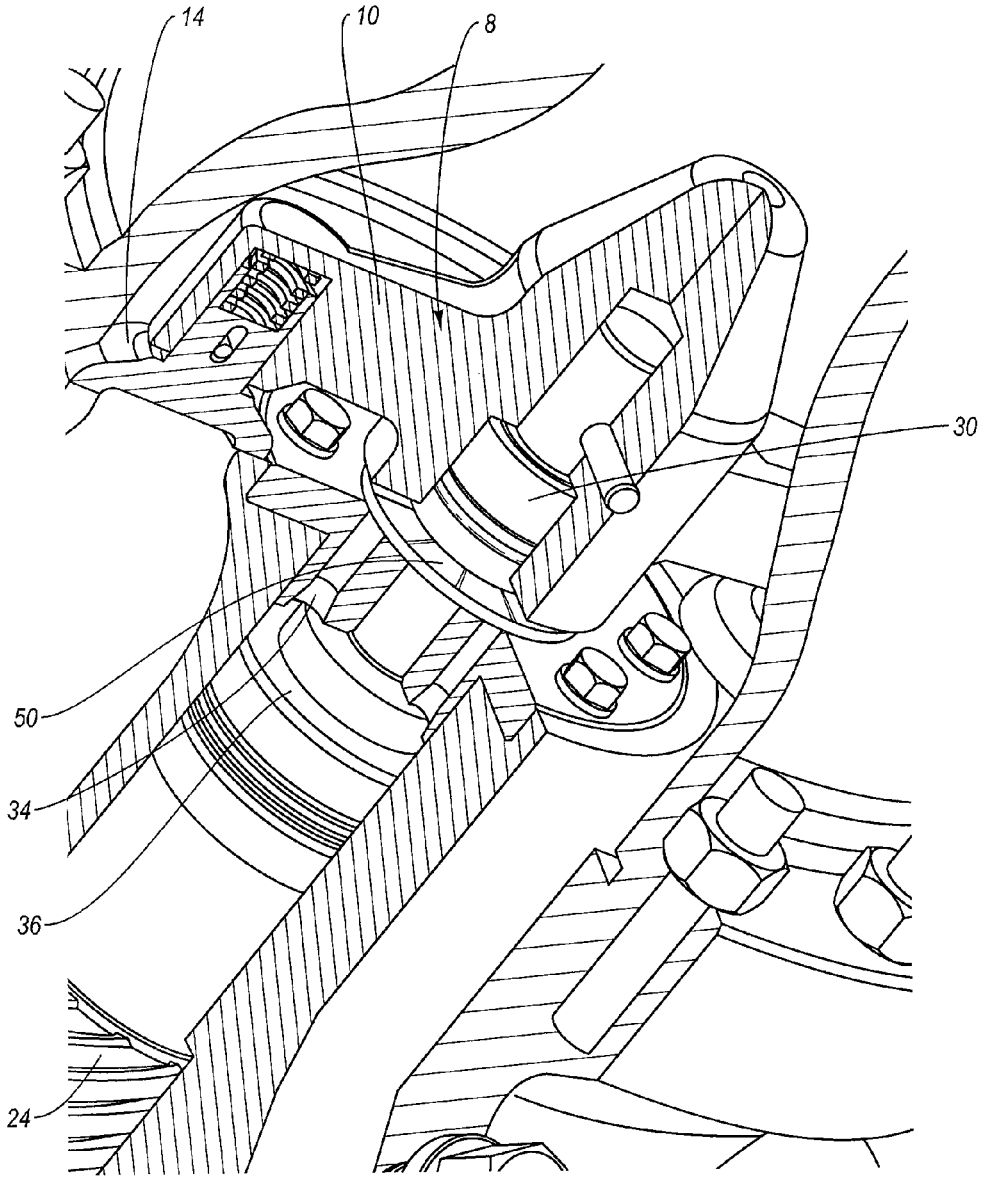
FIG. 8 illustrates an embodiment of the shifting apparatus, particularly depicting the addition of a washer with slits utilized to control the flow of fluids which contact the top of the helical spline.

FIG. 8 depicts an embodiment of the flow diversion apparatus and shifting apparatus of the present invention. In particular, FIG. 8 adds specificity to an embodiment of the invention wherein a washer with slits 50 may be utilized to control the flow of fluids into the small channels 34. By controlling the rate of fluid allowed to flow through the small channels 34 the washer with slits 50 controls the rate at which pressure is exerted on the top of the helical spline 36. Accordingly, in some embodiments the use of a washer with slit allows smoother, more controlled shifting between the boring and cutting modes in the present invention. Some embodiments of the present invention contemplate utilizing and controlling the number and size of slits in the washer 50 such that in some cutting tools more water may be allowed to flow and act upon the top of the helical spline 36 and in some embodiments less fluid would be allowed to act upon the helical spline 36.

FIGS. 7 and 8 additionally illustrate that in some embodiments fluid is prevented from coming in contact with any of the moving or functional parts of the present invention. That is, the internal works of the present invention (e.g., vertically splined post) are isolated from water and/or debris which may cause the internal components of prior art complications to malfunction over time. Because the internal elements of the present invention are isolated from water and debris, their functionality and efficiencies are not diminished as a product of use or time.

In some embodiments of the invention, the various elements of the invention are constructed from durable materials such that the various elements of the invention will not require replacement for substantial period of time. For example, the helical spline 24 of the present invention may be constructed from durable materials and may be capable of efficiently and reliably switching between the boring and cutting modes for substantial periods of time without repair, malfunction or replacement. Likewise, other elements of the cutting tool of the present invention may be constructed from durable materials known in the art.

The present invention provides for a method for switching automatically between the cutting and boring modes in a delayed coker unit operation. In some embodiments, the method actuating remotely the cutting and/or boring modes during the de-coking by an operator without having to raise the drill stem and cutting unit from the coke drum to be manually altered or inspected. Accordingly, in some embodiments, the method as described is comprised of switching between boring and cutting without raising the cutting tool from the coke drum to be decoked.

In some embodiments, the method of the present invention comprises an operator allowing high pressure fluid to flow down the drill stem of a delayed coker unit into the cutting tool 1 wherein the high pressure fluid moves through the drill stem 2 into the cutting tool 1 and into boring passages 48 located on the interior of the cutting tool 1 such that the high pressure fluid is allowed to eject from the boring nozzle 6 of the cutting tool 1. In some embodiments, when high pressure fluids is allowed into the cutting tool, a portion of the high pressure fluids moves into the cutting tool, through small channels 34 in the shifting apparatus collar 38, applying a downward force on the top of the helical spline 36. The high pressure exerted on top of the helical spline 36 forces the helical spline 24 downward against the pressure of a multiple spring system 20, 22 During this step of the method, no fluid is allowed to eject from the cutting nozzles of the cutting tool 1.

In some embodiments of the present invention, an operator may then cut or decrease the flow of high pressure fluid into the drill stem. Accordingly, the flow of the high pressure fluid into the cutting tool 1 is substantially decreased or terminated. In some embodiments, when the operator cuts or decreases the flow of fluids into the cutting head 1, the flow of fluid through the small channels 34 in the shifting apparatus color 38 is decreased and the downward pressure applied to the top of the rotational splined nut 36 is decreased to such an extent that the upward force exhorted by the spring system 20, 22 forces the helical spline 24 in an upward direction. As the helical spline moves in an upward direction, it rotates the main body 10 of the flow diversion apparatus 8 such that the flow diversion apparatus 8 blocks the passages which allow fluid to enter into the boring nozzles 48 and opens the cutting passage 46 allowing fluid to enter into the cutting nozzles 4.

Subsequently, in some embodiments, the operator may increase the flow of fluid into the cutting tool allowing high pressure fluid to be ejected from the cutting nozzles 4 as it flows through the drill stem 2 into the cutting tool 1 and through the cutting passages 46 to the cutting nozzles 4. As high pressure fluids are reintroduced into the cutting head, a portion of the high pressure fluids flow through the shifting apparatus collar 38 through small channels 34 and applies a downward pressure on the top of the helical spline 36, such that the helical spline 24 moves downward and remains in a fully depressed position until the high pressure fluid is cut off.

Thus from the perspective of an operator, the drill stem 2 and cutting tool 1 may be lowered into a coke drum and high pressure fluids may be ejected from a set of boring nozzles 6 in a cutting tool 1. When an operator wants to shift the mode of the cutting tool 1 to a cutting mode, the operator decreases or cuts off the flow of fluid to the cutting tool, allowing the shifting apparatus of the present invention to shift from boring to cutting and then reintroduce high pressure fluids into the drill stem, and cutting tool allowing high pressure fluids to be ejected through the cutting nozzles of the present invention.

What is claimed is:

1. A system for removing coke from a coking vessel comprising:

a cutting head, said cutting head comprising a cutting nozzle, and a boring nozzle;

a flow diversion apparatus structured to block the flow of fluid to one of the cutting nozzles and the boring nozzles; and a shifting apparatus structured to rotate the flow diversion apparatus coupled to the flow diversion apparatus, wherein the shifting apparatus is actuated when water pressure within the cutting head is decreased.

2. The system of claim 1, wherein said shifting apparatus is structured to actuate when fluid pressure within cutting head is changed.

3. The system of claim 1, wherein the flow diversion apparatus comprises a main body and a flow diversion cap.

4. The system of claim 3, wherein the flow diversion apparatus further comprises a force applicator biased between the main body of the flow diversion apparatus and the flow diversion cap.

5. The system of claim 4, wherein the force applicators are springs.

6. The system of claim 1, wherein the shifting apparatus comprises a rotational ratchet mechanism.

7. The system of claim 1, wherein the shifting apparatus comprises a force applicator for moving the shifting apparatus vertically when the water pressure within the cutting tool is changed.

8. The system of claim 6, wherein the force applicator comprises a spring.

9. The system of claim 6, wherein the force applicator comprises more than one spring.

10. A system for removing coke from a coking vessel comprising:

a cutting head;

a flow diversion apparatus; and a shifting apparatus, wherein the shifting apparatus is actuated when water pressure within the cutting head is decreased, comprising a helical spline and a vertically splined post, for rotating said flow diversion apparatus.

11. The system of claim 9, wherein the shifting apparatus further comprises a force applicator for moving the shifting apparatus vertically when the water pressure within the cutting tool is decreased.

12. The system of claim 11, wherein the force applicator comprises a spring.

13. The system of claim 11, wherein the force applicator comprises more than one spring.

14. The system of claim 11, wherein the force applicator comprises two springs, wherein the first spring is wrapped around the outside of the second spring.

15. The system of claim 10, wherein the shifting apparatus further comprises a trust bearing.

16. The system of claim 10, wherein the shifting apparatus further comprises a rotational ratchet mechanism.

17. The system of claim 15, wherein the shifting apparatus further comprises a second rotational ratchet mechanism.

18. The system of claim 10, wherein the shifting apparatus further comprises a collar which couples the shifting apparatus to the interior of the cutting tool.

19. The system of claim 10, wherein the collar comprises small channels which allow fluid to flow though the collar and contact the top of the helical spline.

20. The system of claim 10, wherein the shifting apparatus further comprises an indexing key.

21. A system for removing coke from a coking vessel comprising:

a cutting head, wherein said cutting head comprises a boring nozzle and a cutting nozzle;

a flow diversion apparatus structured to allow flow of fluid exclusively into one of said boring nozzle and into said cutting nozzle; and a shifting apparatus structured to switch said flow diversion apparatus between cutting and boring modes, wherein the shifting apparatus is actuated when water pressure within the cutting head is decreased.

22. The system of claim 21, wherein flow diversion apparatus comprises a main body, a flow diversion cap and force applicator biased between the main body and the flow diversion cap.

23. The system of claim 22, wherein the force applicators comprises a spring.

24. The system of claim 21, wherein the shifting apparatus comprises a rotational ratchet.

25. The system of claim 21, wherein shifting apparatus comprises a force applicator for moving shifting apparatus vertically when the water pressure within the cutting means is changed.

26. The system of claim 25, wherein the force applicator comprises a spring.

27. The system of claim 25, wherein the force applicator comprises more than one spring.

28. The system of claim 21, wherein the shifting apparatus comprises a helical spline.

* * * * *